US008745949B1

(12) United States Patent
Pien

(10) Patent No.: US 8,745,949 B1
(45) Date of Patent: Jun. 10, 2014

(54) METHOD AND APPARATUS FOR FLOORING

(71) Applicant: Chao Kang Pien, Edison, NJ (US)

(72) Inventor: Chao Kang Pien, Edison, NJ (US)

( * ) Notice: Subject to any disclaimer, the term of this patent is extended or adjusted under 35 U.S.C. 154(b) by 0 days.

(21) Appl. No.: 13/861,690

(22) Filed: Apr. 12, 2013

(51) Int. Cl.
*E04B 1/38* (2006.01)
*E04C 1/40* (2006.01)

(52) U.S. Cl.
USPC ..... 52/510; 52/582.1; 52/592.1; 52/462; 52/468; 52/747.1

(58) Field of Classification Search
CPC ..... E04F 19/062; E04F 13/0864; E04F 15/02005; E04F 15/02144; E04F 2201/01; E04B 5/026
USPC ..... 52/509, 510, 582.1, 592.1, 747.1, 52/748.1, 461, 462, 468, 471, 588.1
See application file for complete search history.

(56) References Cited

U.S. PATENT DOCUMENTS

| | | | | |
|---|---|---|---|---|
| 1,978,075 | A | 10/1934 | Butterworth | 52/506.01 |
| 2,455,777 | A | 12/1948 | Jones | 428/204 |
| 2,914,815 | A | 12/1959 | Cook | 52/592.1 |
| 3,551,850 | A | 12/1970 | Dalpee | 332/168 |
| 3,731,445 | A * | 5/1973 | Hoffmann et al. | 52/391 |
| 3,988,187 | A | 10/1976 | Witt | 156/71 |
| 4,426,820 | A | 1/1984 | Terbrack | 52/590.1 |
| 6,763,643 | B1 * | 7/2004 | Martensson | 52/586.1 |
| 6,922,965 | B2 | 8/2005 | Rosenthal | 52/592.1 |
| 6,966,161 | B2 * | 11/2005 | Palsson et al. | 52/589.1 |
| 7,155,871 | B1 | 1/2007 | Stone et al. | 52/591.4 |
| 7,322,159 | B2 | 1/2008 | Stone et al. | 52/741.3 |
| 8,307,600 | B2 * | 11/2012 | Heartsfield | 52/582.1 |
| 2005/0144875 | A1 * | 7/2005 | Lenhard-Backhaus et al. | 52/506.01 |
| 2007/0107359 | A1 * | 5/2007 | Zhang | 52/582.1 |
| 2008/0028712 | A1 * | 2/2008 | Hodgskiss | 52/582.1 |
| 2009/0107076 | A1 * | 4/2009 | Kim | 52/582.1 |
| 2009/0151291 | A1 * | 6/2009 | Pervan | 52/592.1 |
| 2010/0205889 | A1 * | 8/2010 | Anderson | 52/588.1 |
| 2010/0281810 | A1 | 11/2010 | Ruland | 52/588.1 |
| 2010/0319282 | A1 | 12/2010 | Ruland | 52/309.3 |
| 2011/0265409 | A1 * | 11/2011 | Pien | 52/309.1 |
| 2011/0265946 | A1 * | 11/2011 | Pien | 156/268 |
| 2013/0047537 | A1 * | 2/2013 | Dao et al. | 52/309.3 |
| 2013/0167467 | A1 * | 7/2013 | Vermeulen et al. | 52/588.1 |

* cited by examiner

*Primary Examiner* — Brian Glessner
*Assistant Examiner* — Brian D Mattei
(74) *Attorney, Agent, or Firm* — Walter J. Tencza, Jr.

(57) ABSTRACT

An apparatus for flooring including a first connecting piece, a first floor plank, a second connecting piece, and a second floor plank. The first connecting piece may be permanently connected to the first floor plank. The second connecting piece may be permanently connected to the second floor plank. The first floor plank may be temporarily connected to the second floor plank. The first connecting piece may be L-shaped, having a first section and a second section, with the first section of the first connecting piece substantially perpendicular to the second section of the first connecting piece. The second connecting piece may be L-shaped, having a first section and a second section, with the first section of the second connecting piece substantially perpendicular to the second section of the second connecting piece.

16 Claims, 22 Drawing Sheets

METHOD AND APPARATUS FOR FLOORING

FIELD OF THE INVENTION

This invention relates to improved methods and apparatus concerning flooring.

BACKGROUND OF THE INVENTION

There are various devices known in the prior art for flooring.

SUMMARY OF THE INVENTION

In at least one embodiment of the present invention, an apparatus for flooring is provided comprising a first connecting piece, a first floor plank, a second connecting piece, and a second floor plank. The first connecting piece may be permanently connected to the first floor plank. The second connecting piece may be permanently connected to the second floor plank. The first floor plank may be temporarily connected to the second floor plank.

The first connecting piece may be L-shaped, having a first section and a second section, with the first section of the first connecting piece substantially perpendicular to the second section of the first connecting piece. The second connecting piece may be L-shaped, having a first section and a second section, with the first section of the second connecting piece substantially perpendicular to the second section of the second connecting piece.

Each of the first connecting piece and the second connecting piece may be made substantially of plastic, typically a tensile and/or flexible plastic, which may be critical in one or more embodiments to provide flexibility where a floor plank is connected to another floor plank. Typically each of the first floor plank and the second floor plank, may be a floor plank or a floor tile, and may be made of vinyl, rubber, wood, bamboo, WPC (Wood-plastic composite) or any other resilient flooring material.

The first connecting piece may be glued by a permanent glue to the first floor plank. The second connecting piece may be glued by a permanent glue to the second floor plank. The first connecting piece may have a first rail, a second rail, and a first channel in between the first rail and the second rail of the first connecting piece. The second connecting piece may have a first rail, a second rail, and a first channel in between the first rail and the second rail of the second connecting piece. The first connecting piece may be permanently connected to the first floor plank by the first rail of the first connecting piece being permanently connected to the first floor plank within a first channel of the first floor plank. The second connecting piece may be permanently connected to the second floor plank by the first rail of the second connecting piece being permanently connected to the second floor plank within a first channel of the second floor plank.

The first section of the first connecting piece may have a first rail, a second rail, and a first channel in between the first rail and the second rail of the first connecting piece. The second section of the first connecting piece may have a third rail, a fourth rail, and a second channel in between the third rail and the fourth rail of the first connecting piece. The first and second rails and the first channel of the first section of the first connecting piece may be parallel to each other and substantially perpendicular to the third and fourth rails, and the second channel of the second section of the first connecting piece.

The first connecting piece may be permanently connected to the first floor plank by the first rail of the first section of the first connecting piece being permanently connected to the first floor plank within a first channel of the first floor plank, and by the second section of the first connecting piece being permanently connected to the first floor plank within a second channel of the first floor plank.

The first section of the second connecting piece may have a first rail, a second rail, and a first channel in between the first rail and the second rail of the second connecting piece. The second section of the second connecting piece may have a third rail, a fourth rail, and a second channel in between the third rail and the fourth rail of the second connecting piece. The first and second rails and the first channel of the first section of the second connecting piece may be parallel to each other and substantially perpendicular to the third and fourth rails, and the second channel of the second section of the second connecting piece. The second connecting piece may be permanently connected to the second floor plank by the first rail of the first section of the second connecting piece being permanently connected to the second floor plank within a first channel of the second floor plank, and by the second section of the second connecting piece being permanently connected to the second floor plank within a second channel of the second floor plank.

The first connecting piece may be permanently connected to the first floor plank by a permanent adhesive, such as adhesive cement. The second connecting piece may be permanently connected to the second floor plank by a permanent adhesive, such as adhesive cement. The first floor plank may be temporarily connected to the second floor plank by a temporary adhesive, such as a pressure sensitive adhesive.

In at least one embodiment of the present application a method of forming a floor including a plurality of floor planks including a first floor plank and a second floor plank, wherein the method may include permanently connecting a first connecting piece to the first floor plank, permanently connecting a second connecting piece to the second floor plank, and temporarily connecting the first floor plank to the second floor plank. The connecting pieces, floor planks, and materials for connection used in the method may be as previously specified.

DETAILED DESCRIPTION OF THE DRAWINGS

Figure 1A:
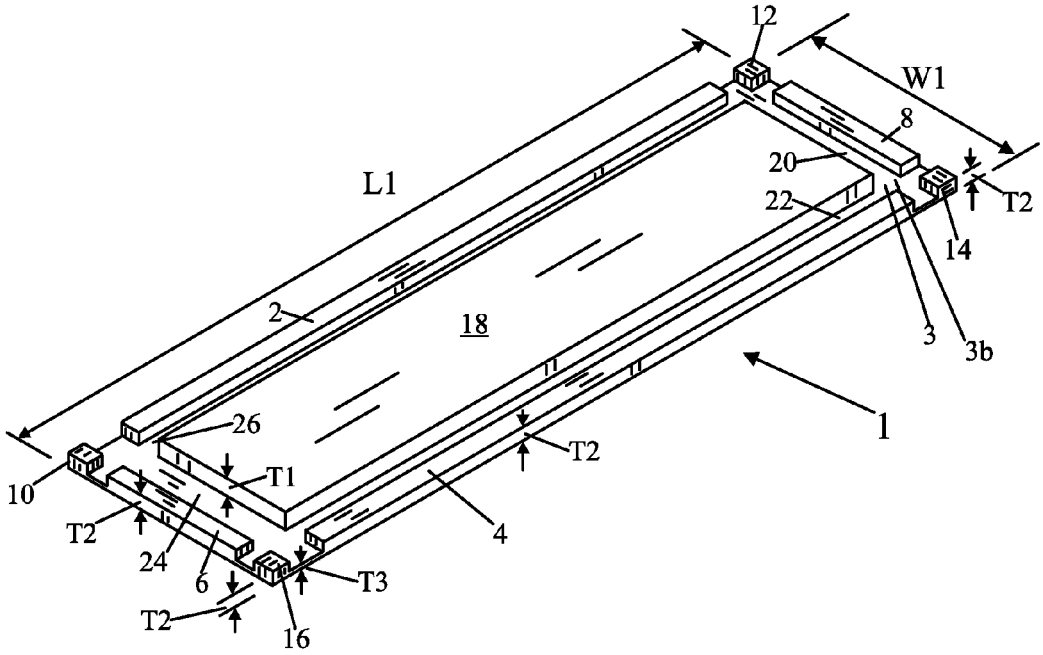
Fig. 1A (Prior Art)
FIG. 1A shows a bottom, front, right perspective view of a prior art floor plank, wherein generally speaking in the present application a floor plank may be, for example, a floor plank or a floor tile.
Figure 1B:
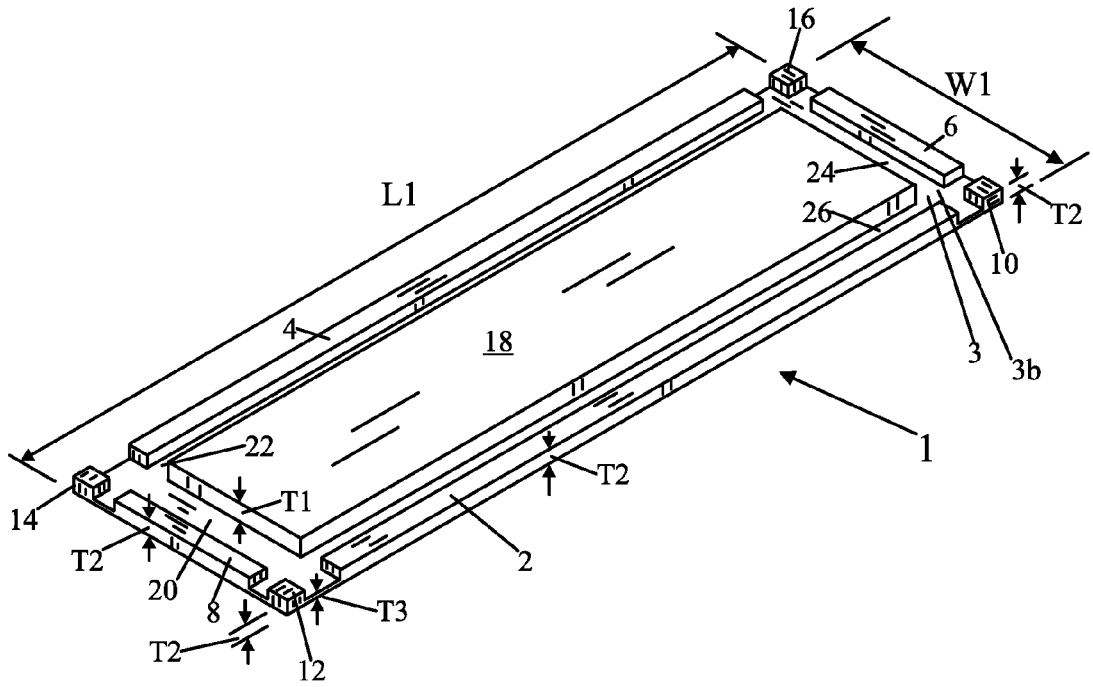
Fig. 1B (Prior Art)
FIG. 1B shows a bottom, rear, left perspective view of the floor plank of FIG. 1A.
Figure 1C:
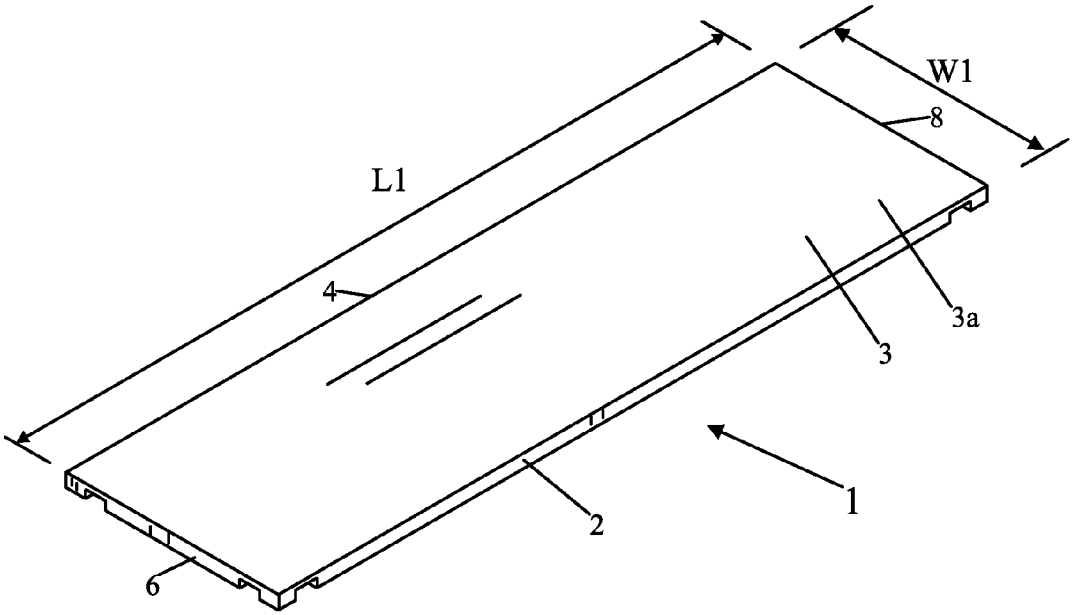
Fig. 1C (Prior Art)
FIG. 1C shows a top, front, left perspective view of the floor plank of FIG. 1A.
Figure 1D:
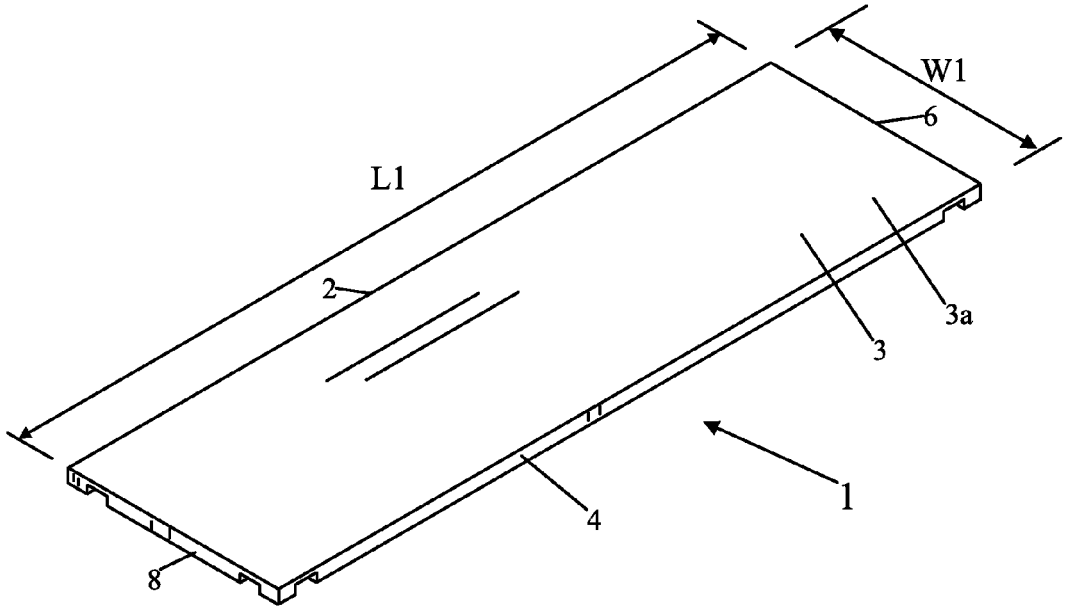
Fig. 1D (Prior Art)
FIG. 1D shows a top, rear, right perspective view of the floor plank of FIG. 1A.

FIG. 1A shows a bottom, front, right perspective view of a prior art floor plank 1. FIG. 1B shows a bottom, rear, left perspective view of the floor plank 1. FIG. 1C shows a top, front, left perspective view of the floor plank 1. FIG. 1D shows a top, rear, right perspective view of the floor plank 1. The floor plank 1 includes rails or protrusions 2, 4, 6, 8, 10, 12, 14, and 16. The floor plank 1 also includes center section or protrusion 18. The floor plank 1 also includes channels 20, 22, 24, and 26. The floor plank 1 also includes floor section 3 which has a top surface 3*a* shown in FIGS. 1C and 1D, and a bottom surface 3*b* shown in FIGS. 1A and 1B.

The floor plank 1 has a length L1 and a width W1 shown in FIG. 1C. The length L1 may be, for example eighteen, twenty-four, thirty-six or forty-eight inches or any other length. The width W1 may be, six, eight, nine, or twelve inches or any other width. The length L1 is typically substantially greater than the width W1.

The floor section 3 may have a thickness of T3 shown in FIG. 1A which may be about 2.0 millimeters or 0.08 inches. The protrusions 2, 4, 6, 8, 10, 12, 14, and 16 may have a thickness T2, which is typically greater than the thickness T3 of the floor section 3, wherein the thickness T2 may be about 3.9 millimeters. The center section or protrusion 18 may have a thickness T1+T3 which typically may be greater than either T2 or T1, where T1+T3 may be about 0.16 inches or 4.0 millimeters, or in some embodiments 5.0 millimeters.

The plank 1 may be formed by a process similar or identical the process disclosed in U.S. Pat. No. 8,268,110, to Pien, issued on Sep. 18, 2012, incorporated by reference herein. The plank 1 may be made of materials such as disclosed in U.S. Pat. No. 8,268,110 to Pien, incorporated by reference herein.

Figure 2A:
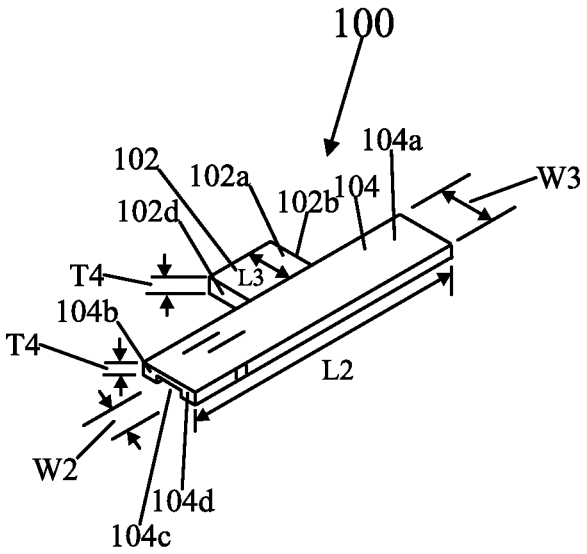
Fig. 2A (Prior Art)
FIG. 2A shows a bottom, front, right perspective view of a prior art connecting piece.
Figure 2B:
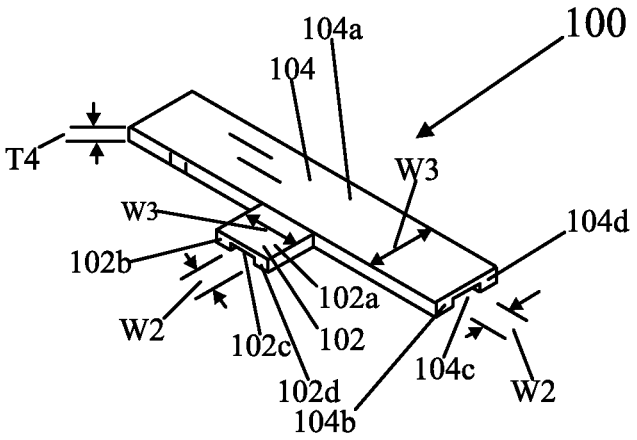
Fig. 2B (Prior Art)
FIG. 2B shows a bottom, left, front perspective view of the connecting piece of FIG. 2A.
Figure 2C:
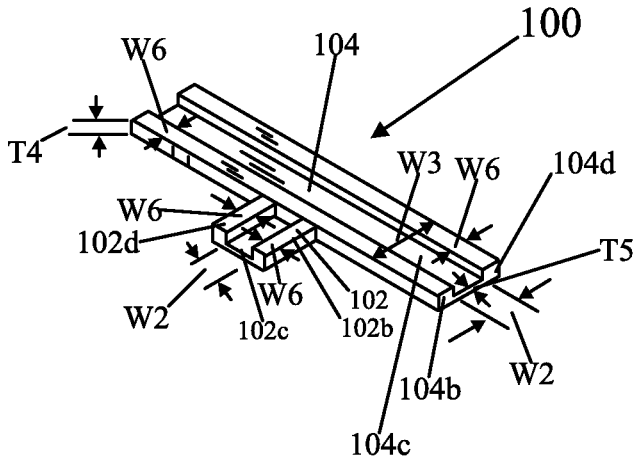
Fig. 2C (Prior Art)
FIG. 2C shows a top, left, rear perspective view of the connecting piece of FIG. 2A.

FIG. 2A shows a bottom, front, right perspective view of a prior art connecting piece 100. FIG. 2B shows a bottom, left, front perspective view of the connecting piece 100. FIG. 2C shows a bottom, left, rear perspective view of the connecting piece 100.

The connecting piece 100 includes a section 102 integrated with a section 104 in a T-shaped configuration, with the section 102 perpendicular to the section 104. The section 102 includes top surface 102*a* shown in FIG. 2A, rails 102*b* and 102*d*, and channel 102*c* shown in FIG. 2C. The section 104 includes top surface 104*a* shown in FIG. 2A, rails 104*b* and 104*d*, and channel 104*c* shown in FIG. 2C.

Each of the channels 102*c* and 104*c* have a width W2 which may be about two eighths of an inch. Each of the rails 102*b*, 102*d*, 104*b*, and 104*d* have a width W6 which may be about one eighth of an inch. Each of sections 102 and 104 may have a thickness T4, such as shown in FIG. 2C, which may be about 2.1 millimeters. Each of the sections 102 and 104 may have a thickness T5, shown in FIG. 2C, which is typically less than T4, wherein T5 may be about 0.1 (1/10) millimeters. Each of the sections 102 and 104 may have a width W3 which may be equal to W2+two times W6, or about four eighths (1/2) of an inch.

The connecting piece 100 may made substantially or entirely of a hard, rigid, plastic material, but typically flexible and/or tensile, and not easy to be broken or deformed.

Figure 3A:
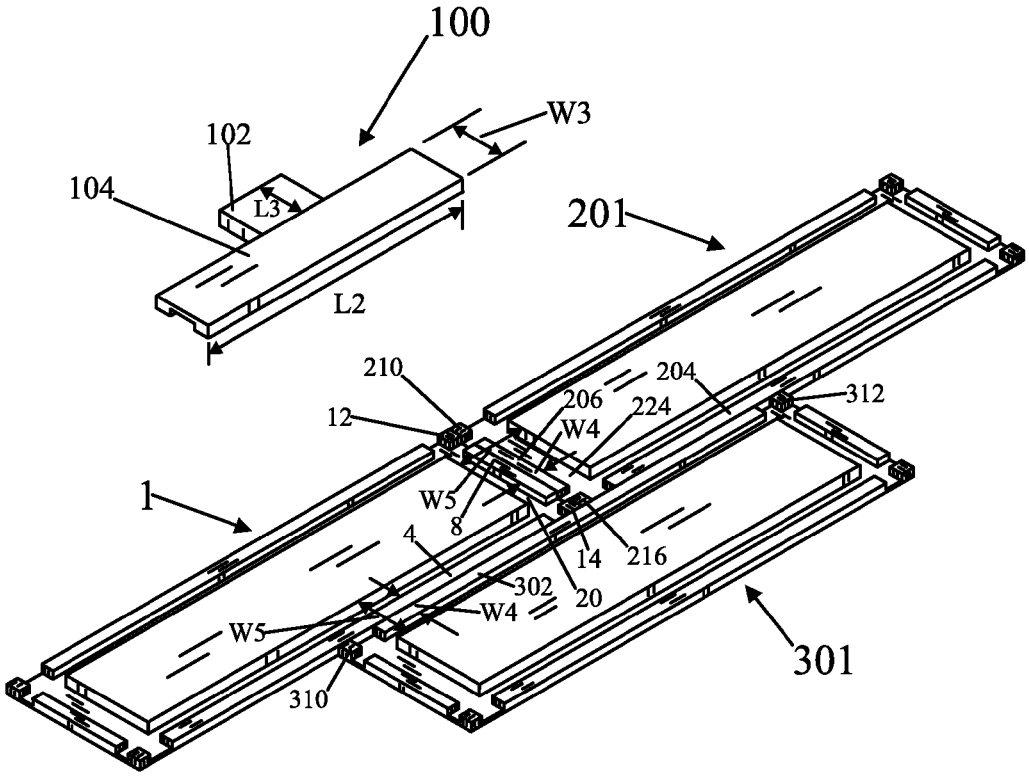
Fig. 3A (Prior Art)
FIG. 3A shows a bottom, front, right perspective view of the connecting piece of FIG. 2A, along with a bottom, front, right perspective view of three floor planks, each identical to the floor plank of FIG. 1A, with the connecting piece separate from and not contacting the three floor planks.

FIG. 3A shows a bottom, front, right perspective view of the connecting piece 100 of FIG. 2A, along with a bottom, front, right perspective view of three floor planks 1, 201, and 301, each identical to the floor plank 1 of FIG. 1A, with the connecting piece 100 shown separate from and not contacting the three floor planks 1, 201, and 301.

Figure 3B:
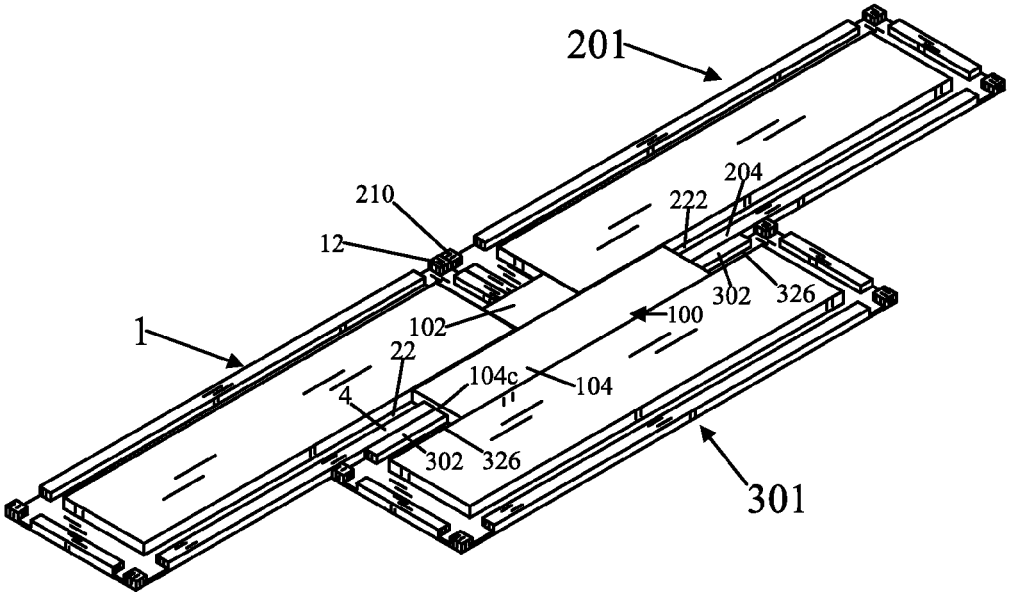
Fig. 3B (Prior Art)
FIG. 3B shows a bottom, front, right perspective view of the connecting piece of FIG. 2A, along with a bottom, front, right perspective view of three floor planks, each identical to the floor plank of FIG. 1A, with the connecting piece contacting the three floor planks so as to connect the three floor planks.

FIG. 3B shows a bottom, front, right perspective view of the connecting piece 100, along with a bottom, front, right perspective view of the three floor planks 1, 201, and 301, with the connecting piece 100 contacting the three floor planks 1, 201, and 301, so as to connect the three floor planks 1, 201, and 301. In FIG. 3B, the connecting piece 100 has been placed so that the section 102 joins together the floor planks 1 and 201, while the section 104 joins together the floor planks 1, 201, and 301.

In FIG. 3B, the connecting piece 100 has been placed so that rails or protrusions 102*d* and 102*b* are inserted into and lie in channels 20, and 224, respectively. In addition, the rails or protrusions 8, and 206 are inserted into and lie in channel 102*c*. Each of the rails or protrusions 8 and 206 may a width of one eighth of an inch, and when rail 8 and 206 are in contact and adjacent to each other as in FIG. 3A, the width W4 of a combination of rail 8 and 206 may be about one quarter ¼ of an inch. Each of channels 20 and 224 may have a width of one eighth of an inch, and a combination of the width of the channels 20, rail 8, rail 206, and channel 224 as shown in FIG. 3A, may be a width of W5 (W5=width of channel 20 (⅛ of an inch)+width of channel 224 (⅛ of an inch)+width of protrusion or rail 8 (⅛ of an inch)+width of protrusion or rail 206 (⅛ of an inch), which may be four eighths of an inch or one half (½) of an inch.

Thus, each of rails 102*d* and 102*b* shown in FIG. 2C, which may be about one eighth of an inch in width, or less, are configured to snugly fit into channels 20 and 224, shown in FIG. 3A, which may be about one eighth of an inch in width. In addition the channel 102*c* may have width, W2, which may be about two eighths (⅜) of an inch in width, which allows for insertion of rails 8, and 14 from plank 1 and 206, and 216 from plank 201, each of which may be one eighth of an inch in width, for a total of two eighths of an inch (width of rail 8 plus width of rail 206), W4 in width, which can fit within channel 102*c*.

In addition, the thickness T5 of the connecting piece 100 shown in FIG. 2C may be about 0.1 millimeters, which adds to the thickness T2 (shown in FIG. 1A, which may be about 3.9 millimeters or less), of either the plank 1 or the plank 201, so that inserting the connecting piece 100 as shown in FIG. 3B does not exceed the overall thickness (T1+T3, shown in FIG. 1A, 4.0 millimeters, of the floor plank 1 or 201. I.e. the overall thickness T1+T3 may be 4.0 millimeters, while the thickness, T2, shown in FIG. 1A, of the rail 8 or 6, plus the thickness T5 of the connecting piece 100 shown in FIG. 2C, which may be 0.1 millimeters would be about 4.0 millimeters or less. To provide a level floor, the combination of the thickness T5 of the connecting piece 100 and the thickness of protrusion 8 should be less than or equal to the overall thickness T1+T3 (about 4.0 millimeters), of the plank 1.

In FIG. 3B, the connecting piece 100 has been placed so that rails or protrusions 104*b* and 104*d* are inserted into and lie in channels 22, and 326, of plank 1 and 301, respectively. In addition, the rails or protrusions 4, 204, and 302, of planks 1, 201, and 301, are inserted into and lie in channel 104*c*. Each of the rails or protrusions 4, 204, and 302 may a width of one eighth of an inch, and when rail 8 and 302 are in contact and adjacent to each other as in FIG. 3B, the width W4 of a combination of rail 8 and 302 may be about one quarter of an inch. Each of channels 22 and 326 may have a width of one eighth of an inch, and a combination of the width of the channel 22, rail 4, rail 302, and channel 326 as shown in FIG. 3B, may be a width of W5 which may be four eighths, or one half of an inch.

Thus, each of rails 104*b* and 104*d*, which may be about one eighth of an inch in width, or less, are configured to snugly fit into channels 22 and 326, respectively, which may be about one eight of an inch in width each. In addition, the channel 104*c* may have about two eighths or one quarter of an inch in width, W2, which allows for insertion of rails 4 and 14 from plank 1, 302 from plank 301, and 216, and 204 from plank 201, each of which may be one eighth of an inch in width, for a total of two eighths of an inch (width of rail 4 plus width of rail 302 shown in FIG. 3A), W4 in width, which can fit within channel 104*c*.

In addition, the thickness T5 of the connecting piece 100 shown in FIG. 2C may be about 0.1 millimeters, which adds to the thickness T2 (shown in FIG. 1A) which may be about 3.9 millimeters or less, of either the plank 1 or the plank 201, so that inserting the connecting piece 100 as shown in FIG. 3B does not exceed the overall thickness (T1+T3, shown in FIG. 1A, typically 4.0 millimeters), of the floor plank 1 or 201. I.e. the overall thickness T1+T3 may be 4.0 millimeters, while the thickness of the rail 4 plus the thickness T5 of the connecting piece 100 would be 4.0 millimeters or less. To provide a level floor, the combination of the thickness T5 of the connecting piece 100 and the thickness of protrusion 4 should be less than or equal to the overall thickness T1+T3, of the plank 1.

Figure 4A:
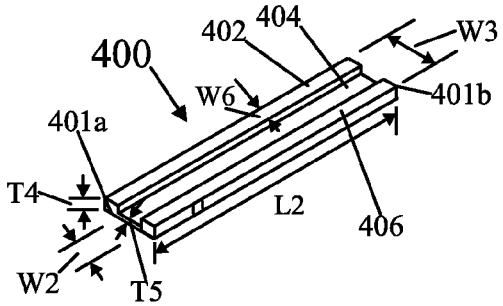
FIG. 4A shows a top, front, left side perspective view of a first connecting piece in accordance with an embodiment of the present invention.
Figure 4B:
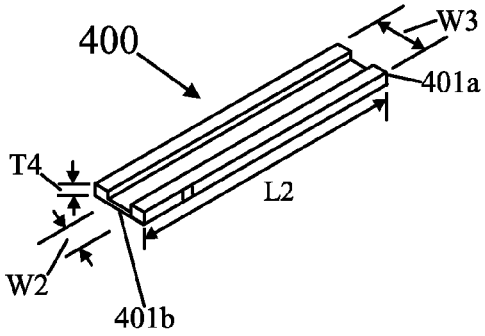
FIG. 4B shows a top, rear, right side perspective view of the first connecting piece of FIG. 4A.
Figure 4C:
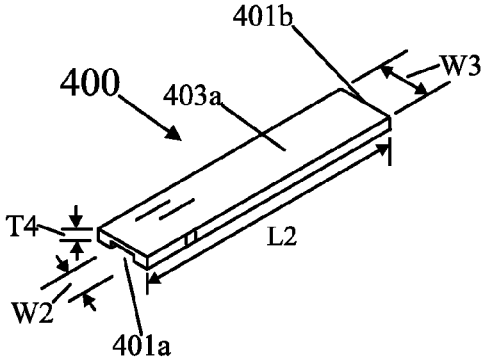
FIG. 4C shows a bottom, front, right side perspective view of the first connecting piece of FIG. 4A.
Figure 4D:
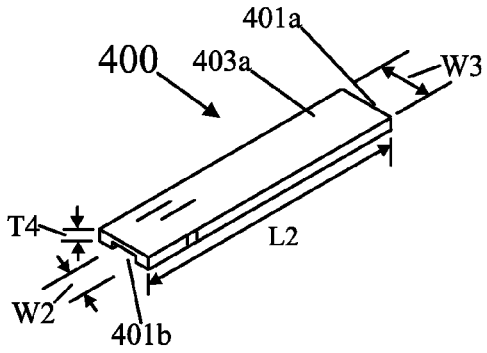
FIG. 4D shows a bottom, rear, left side perspective view of the first connecting piece of FIG. 4A.

FIG. 4A shows a top, front, left side perspective view of a first connecting piece 400 in accordance with an embodiment of the present invention. FIG. 4B shows a top, rear, right side perspective view of the first connecting piece 400. FIG. 4C shows a bottom, front, right side perspective view of the first connecting piece 400. FIG. 4D shows a bottom, rear, left side perspective view of the first connecting piece 400.

The first connecting piece 400 includes rails or protrusions 402 and 406 and a channel 404. The first connecting piece 400 has an end 401*a* and an end 401*b*. The first connecting piece has a length L2, which may be about between five and three quarters (5 and ¾) inches and six inches or any other size, and has a width W3 which may be about one half (½) of an inch. The channel has a width of W2 which may be about two eighths of an inch, a thickness T4 which may be about two millimeters, and a thickness T5 which may be about 0.1 millimeters.

Figure 5A:
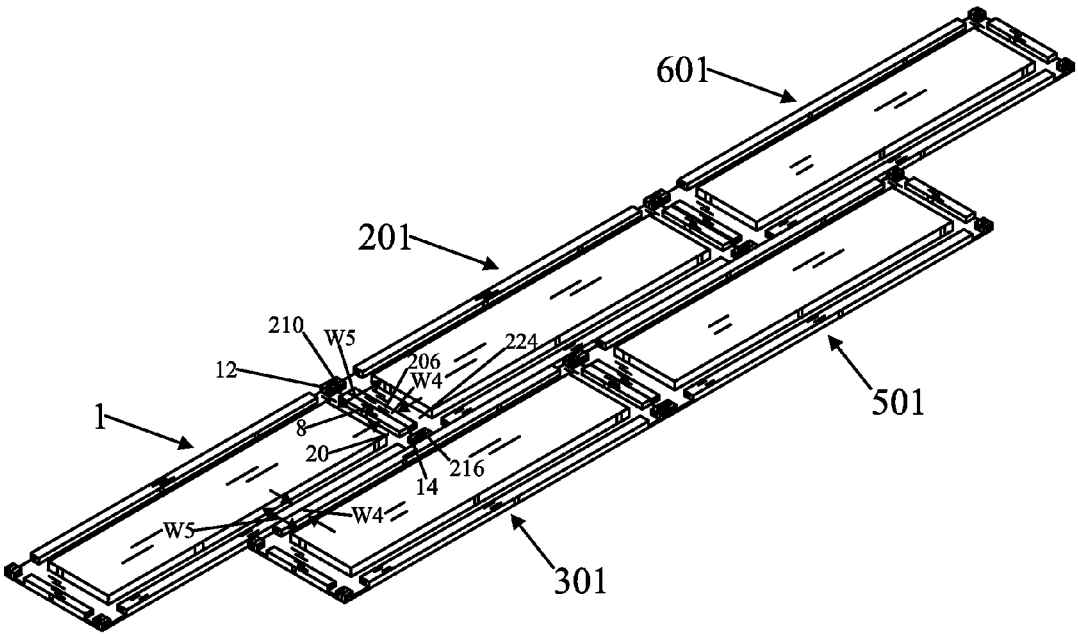
FIG. 5A shows a bottom, front, right perspective view of five floor planks, each identical to the floor plank of FIG. 1A.

FIG. 5A shows a bottom, front, right perspective view of five floor planks 1, 201, 301, 501, and 601, each identical to the floor plank 1 of FIG. 1A. The five floor planks 1, 201, 301, 501, and 601 are arranged in FIG. 5A, so that the floor plank 1 is in contact with and adjacent to the floor plants 301 and 201; the floor plank 301 is in contact with and adjacent to the floor planks 201 and 501; the floor plank 201 is in contact with and adjacent to the floor planks 1, 501, and 301; and the floor plank 501 is in contact with and adjacent to the floor planks 201 and 601.

Figure 5B:
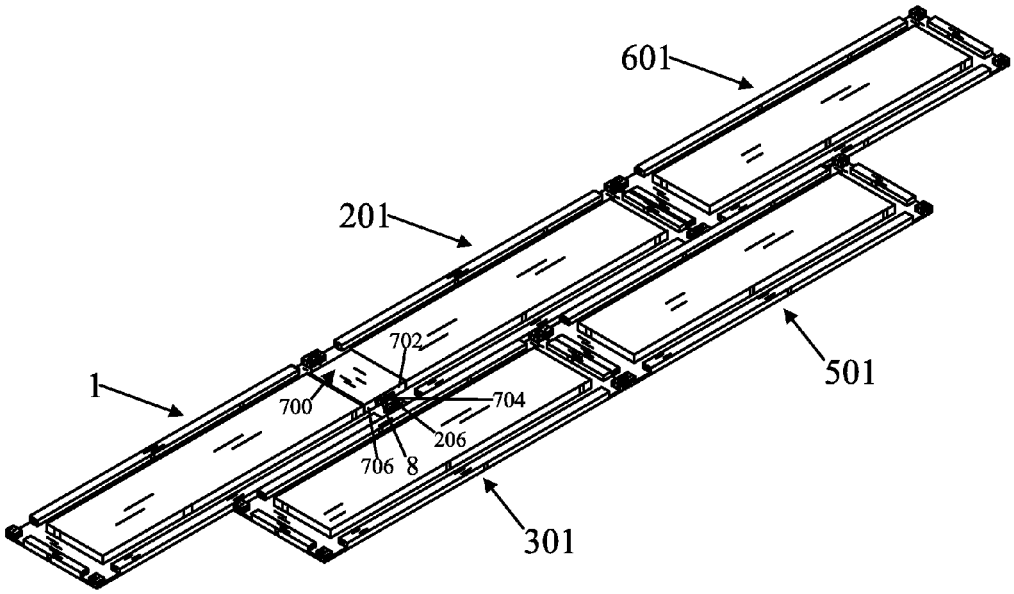
FIG. 5B shows a bottom, front, right perspective view of the five floor planks of FIG. 5A along with the first connecting piece of FIG. 4A contacting at least two of the five floor planks so at to connect at least two of the five floor planks.

FIG. 5B shows a bottom, front, right perspective view of the five floor planks 1, 201, 301, 501, and 601 arranged as in FIG. 5A, along with a second connecting piece 700 contacting at least two of the five floor planks so at to connect at least two of the five floor planks 1, 201, 301, 501, and 601. The connecting piece 700 may be identical to the connecting piece 400 only shorter than the connecting piece 400. In FIG. 5B, the connecting piece 700 has been placed so that rails or protrusions 706 and 702 are inserted into and lie in channels 20, and 224, respectively. In addition, the rails or protrusions 8, and 206 are inserted into and lie in a channel 704 of the connecting piece 700. Each of the rails or protrusions 8 and 206 may a width of one eighth of an inch, and when rail 8 and 206 are in contact and adjacent to each other as in FIG. 5A, the width W4 of a combination of rail 8 and 206 may be about one quarter of an inch. Each of channels 20 and 224 may have a width of one eighth of an inch, and a combination of the width of the channels 20, rail 8, rail 206, and channel 224 as shown in FIG. 5A, may be a width of W5 which may be four eighths of an inch or one half of an inch.

Thus, rails 702 and 706, each of which may be about one eighth of an inch in width, or less, are configured to snugly fit into channels 20 and 224, respectively, each of which may be about one eight of an inch in width. In addition the channel 704 may have about two eighths of an inch in width, W2, which allows for insertion of rail 8 from plank 1 and rail 206 from plan 201, each of which may be one eighth of an inch in width, for a total of two eighths of an inch (width of rail 8 plus width of rail 206), W4 in width, which can fit within channel 704.

In addition, the thickness T5 of the connecting piece 700, same as the thickness T5 for piece 400 shown in FIG. 4A, may be about 0.1 millimeters, which adds to the thickness T2 (shown in FIG. 1A) which may be 3.9 millimeters or less, of either the plank 1 or the plank 201, so that inserting the connecting piece 700 as shown in FIG. 5B does not exceed the overall thickness (T1+T3, shown in FIG. 1A, typically 4.0 millimeters), of the floor plank 1 or 201. I.e. the overall thickness T1+T3 may be 4.0 millimeters, while the thickness of the rail 8 (3.9 millimeters or less) plus the thickness T5 (0.1 millimeters) of the connecting piece 700 would be 4.0 millimeters or less. To provide a level floor, the combination of the thickness T5 of the connecting piece 700 and the thickness of protrusion 8 should be less than or equal to the overall thickness T1+T3, of the plank 1.

Figure 5C:
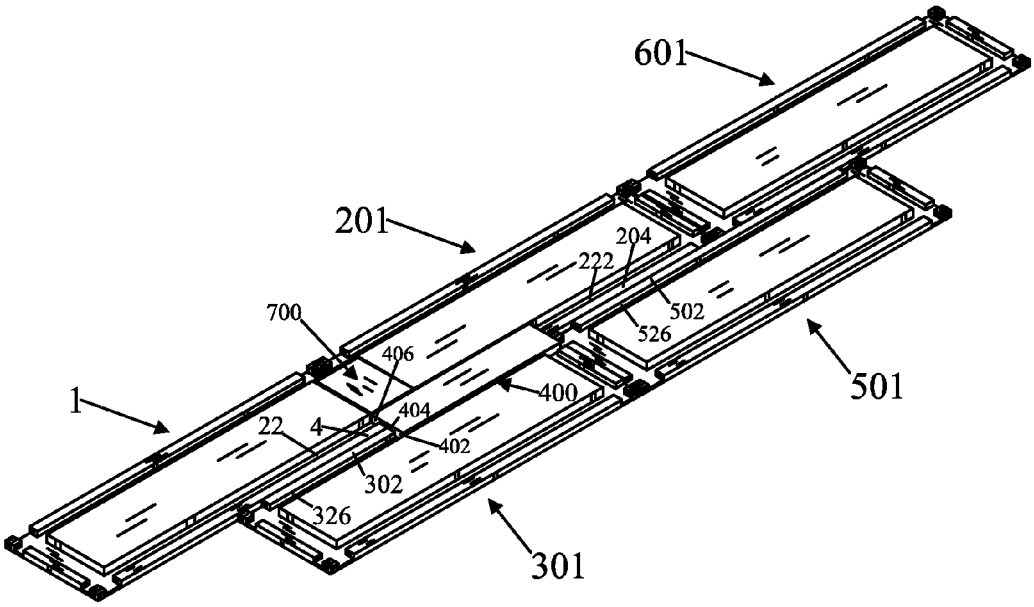
FIG. 5C shows a bottom, front, right perspective view of the five floor planks of FIG. 5A along with the first connecting piece, and a second connecting piece, each of which may be identical to the first connecting piece of FIG. 4A, each contacting at least two of the five floor planks so at to connect at least two of the five floor planks.

FIG. 5C shows a bottom, front, right perspective view of the five floor planks 1, 201, 301, 501, and 601, along with the first connecting piece 400, and the second connecting piece 700. The piece 700 may be identical to the piece 400, except the piece 700 is shorter. Each of the connecting pieces 400 and 700 may contact at least two of the five floor planks 1, 201, 301, 501, and 601 so at to connect at least two of the five floor planks 1, 201, 301, 501, and 601.

In FIG. 5C, protrusions or rails 406 and 402 may be inserted into and lie in channels 22 and 326. Rails 4 and 302 may be inserted in and lie in channel 404 of piece 400.

Figure 5D:
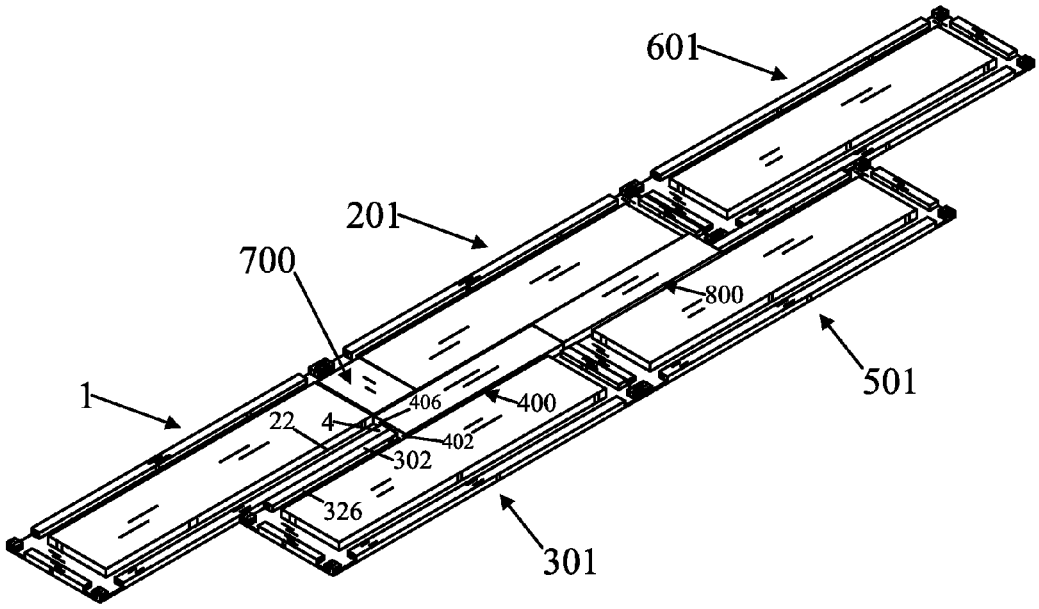
FIG. 5D shows a bottom, front, right perspective view of the five floor planks of FIG. 5A along with the first, the second, and a third connecting piece, each of which may be identical to the first connecting piece of FIG. 4A, each contacting at least two of the five floor planks so at to connect at least two of the five floor planks.

FIG. 5D shows a bottom, front, right perspective view of the five floor planks 1, 201, 301, 501, and 601, along with the first, the second and a third connecting pieces 400, 700, and 800. Each of the connecting pieces 400, 700, and 800 may be identical to the first connecting piece 400, except connecting piece 700 is shorter than pieces 400 and 800. Each of pieces 400, 700, and 800 may contact at least two of the five floor planks 1, 201, 301, 501, and 601 so at to connect at least two of the five floor planks. 1, 201, 301, 501, and 601.

In FIG. 5D, protrusions or rails of piece 800, analogous to rails 406 and 402, but not shown in FIG. 5D, may be inserted into and lie in channels 222 and 526. Rails 204 and 502 may be inserted in and lie in channel analogous to channel 404, but not shown in FIG. 5D of piece 400.

Generally speaking the connecting piece 400, 700, and 800 may be different sizes. The connecting piece 400 may have for example, a length L2, which is one half of the length L1 of the floor plank 1 or 1/16 or 2/16 inches shorter than half of the length of L1.

In accordance with one or more embodiments of the present invention, each of the connecting pieces 400, 700, and 800 may be made substantially or entirely of polypropylene. In contrast the connecting piece 100 of the prior art shown in FIGS. 2A-C was made with acrylonitrile butadiene styrene (ABS). The inventor has determined that the polypropylene material is critical in at least one or more embodiments, and is more tensile and more effective that the acrylonitrile butadiene styrene (ABS) material of the prior art.

In addition, in the prior art referring to FIG. 3B, the connecting piece 100 was typically loosely connected to the floor planks 1, 201, and 301, which undesirably allowed a vacuum cleaner to suck or pick the floor planks 1, 201, and 301 up and place them out of position. In addition, in the prior art it was not easy to locate or connect the connecting piece 100 loosely beneath the floor planks 1, 201, and 301. Furthermore, as the subfloor or underlayment usually won't be perfectly level or flat, a loose floor plank as in the prior art may make it more difficult to locate and position the rails and channels.

In accordance with a method of one or more embodiments of the present invention, a tacky or sticky coating is first placed in one or more channels before the connecting pieces 700, 400, and/or 800 are placed as in FIGS. 5B, 5C, and 5D. For example, a tacky or sticky coating may be placed in channels 20, and 224 shown in FIG. 5A. Thereafter the connecting piece 700 may be inserted as shown and described previously with reference to FIG. 5B. Additionally or alternatively, a tacky and/or sticky coating may be placed in channel 704 or on rails 702 and 706 shown in FIG. 4A of piece 700 before it is placed as in FIG. 5B.

The following is an alternative or additional method of connecting and/or fixing planks 1, 201, 601, 301, and 501, with connecting pieces 700, 400, and 800. In at least one embodiment, the connecting pieces 700, 400, and 800 may be permanently fixed on plank 201 by nailing, by adhesive cement, or by other power bonding glue in the positions shown in FIG. 5D, before connecting planks 1, 301, 501, and 601. Thereafter, a special coating (which is tacky and/or sticky but not permanent) such as the anti-slip coating of a composition A, disclosed in patent application Ser. No. 13/851,635, filed on Mar. 27, 2013, incorporated by reference herein, or a hot-melt pressure sensitive glue such as disclosed in U.S. Pat. No. 8,268,110, incorporated by reference herein, may be applied to channel 20 of plank 1 and channel 326 of plank 301, and thereafter the connecting pieces 700 and 400 may be connected to plank 1 and plank 301 as shown in FIG. 5C. In at least one embodiment, every plank, such as every plank of 1, 201, 301, and 501, and 601, may have one width side nailed or permanently glued with a connecting piece and one length side nailed or permanently glued with a connecting piece (such as one of 700, 400, and 800), and have its other width side connected to a connecting piece (such as of 700, 400, and 800) and its other length side connected to a connecting piece (such as of 700, 400, and 800) with a tacky, sticky, but non permanent coating or material, such as anti-slip coating of a composition A disclosed in Ser. No. 13/851,635 or pressure sensitive glue such as disclosed in U.S. Pat. No. 8,268,110. The sides of a plank (of 1, 201, 301, 501, and 601), connected to connecting piece (of 400, 700, and 800) with the non-permanent material help to connect but still easy to remove the connecting piece. The sides of plank (of 1, 201, 301, 501, and 601) connected to connecting piece (of 400, 700, and 800) by nailing or permanent adhesive, help to provide a strong and effective attachment to outperform loose pieces of prior art. When using an L-shaped connecting piece 1000 of FIG. 8A, the connecting piece 1000 would be permanently fixed along the width and length of one plank, such as plank 201, and connected by non permanent material to other planks, such as plank 1 and 301, if piece 1000 is substituted in place of pieces 700 and 400 in the configuration of FIG. 5D.

A tacky or sticky coating may be placed in channels 22 and 326 shown in FIG. 5B before placing piece 400, and/or such a coating may be placed on rails 406 and 402 or in channel 404, or on rails 4 and 302, before inserting piece 400 as in FIG. 5C. Similarly, a tacky or sticky coating may be placed in channels 222 and 526 shown in FIG. 5C before placing piece 800, and/or such a coating may be placed on rails analogous to rails 406 and 402, for piece 800, or in a channel analogous to channel 404, for piece 800, or on rails 204 and 502, before inserting piece 800 as in FIG. 5D.

Note that FIG. 5A shows the planks 1, 201, 301, 501, and 601 upside down, to show the attachment to connecting pieces, such as one or more of 700, 400, and 800. Typically, the planks 1, 201, 301, 501, and 601, would be right side up as in FIGS. 1C and 1D, so floor top surfaces, similar, or identical to surface 3*a* in FIGS. 1C and 1D, would show, and would be stepped on, when an entire floor is installed.

The tacky or sticky coating referred to above may be a hot melt pressure sensitive adhesive or a coating such as described in U.S. patent application Ser. No. 13/851,635, filed on Mar. 27, 2013, inventor Chao Kang Pien, which is incorporated by reference herein. For example, the tacky or sticky coating referred to above may be an anti-slip backing coating of a composition A, as referred to in U.S. patent application Ser. No. 13/851,635, wherein the coating of a composition A, in at least one embodiment, is a water based synthetic material having about 35% to 42% water, about 8% to 10% dipropylene glycol, about 40% to 50% polypropylene homopolymer, and about 6% to 8% n-butyl ether by weight. In at least one embodiment, these proportions are critical.

Figure 6A:
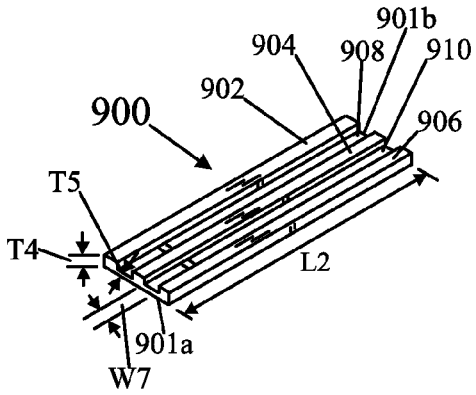
FIG. 6A shows a top, front, left side perspective view of a fourth connecting piece in accordance with another embodiment of the present invention.
Figure 6B:
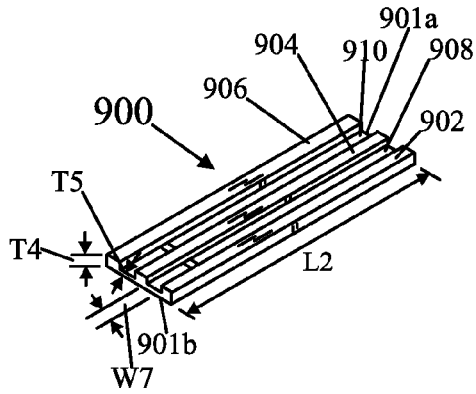
FIG. 6B shows a top, rear, right side perspective view of the fourth connecting piece of FIG. 6A.
Figure 6C:
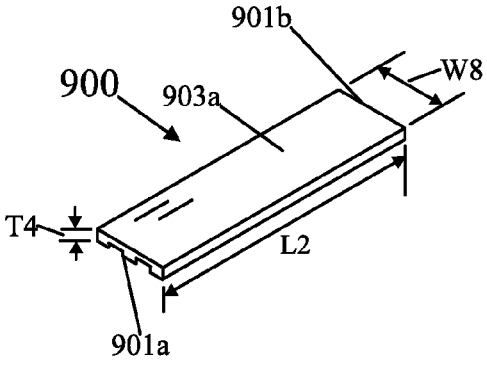
FIG. 6C shows a bottom, front, right side perspective view of the fourth connecting piece of FIG. 6A.
Figure 6D:
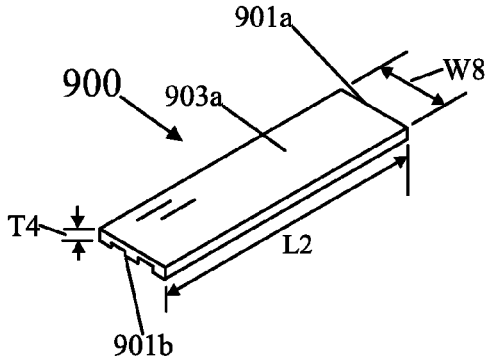
FIG. 6D shows a bottom, rear, left side perspective view of the fourth connecting piece of FIG. 6A.

FIG. 6A shows a top, front, left side perspective view of a fourth connecting piece 900 in accordance with another embodiment of the present invention. FIG. 6B shows a top, rear, right side perspective view of the fourth connecting piece 900. FIG. 6C shows a bottom, front, right side perspective view of the fourth connecting piece 900. FIG. 6D shows a bottom, rear, left side perspective view of the fourth connecting piece 900.

The connecting piece 900 includes rails or protrusions 902, 904, and 906, and channels 908 and 910. The connecting piece 900 has an end 901*a* and an end 901*b*. The connecting piece 900 has a surface 903*a* shown in FIGS. 6C and 6D. The connecting piece 900 or a plurality of pieces identical to the connecting piece 900 can be used instead of the pieces 400, 700, and 800. The connecting piece 900 can be used in a manner which creates a visual effect of grout.

Figure 7:
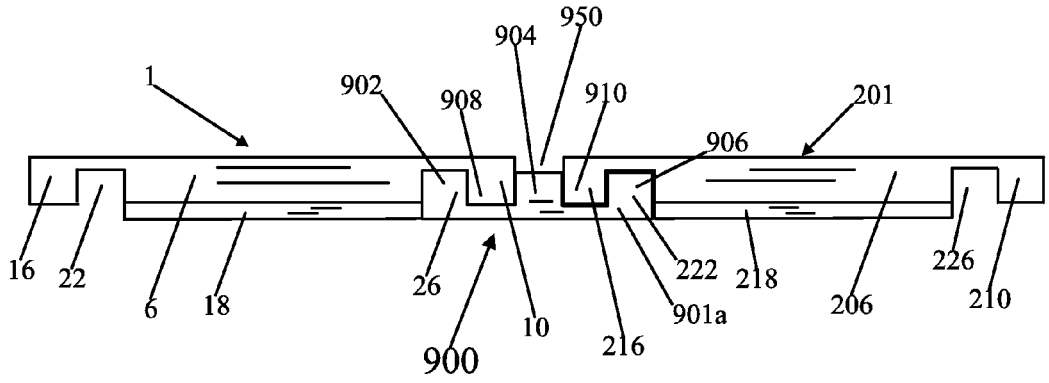
FIG. 7 shows a front view of the plank of FIG. 1A, connected to an identical plank by the fourth connecting piece of FIG. 6A, wherein generally floor planks in the present application include floor planks and floor tiles, and the FIG. 7 embodiment may be particularly useful for floor tiles.

FIG. 7 shows a front view of plank 1, connected to plank 201 by the fourth connecting piece 900 of FIG. 6A. In FIG. 7, the protrusion or rail 10 of the plank 1 and 216 of the plank 201 have been inserted into and lie in the channels 908 and 910, respectively, of the connecting piece 900. The protrusion or rails 902 and 906 of the connecting piece 900 have been inserted into and lie in the channels 26 of the plank 1 and 222 of the plank 201, respectively. A gap 950 is created as shown in FIG. 7, which provides, in at least one embodiment, the visual effect of grout.

In FIG. 7, the plank 1 may be a floor tile or a floor plank. In particular for a floor tile, the middle protrusion 904 may be particularly useful to create the appearance or effect of grout.

Figure 8A:
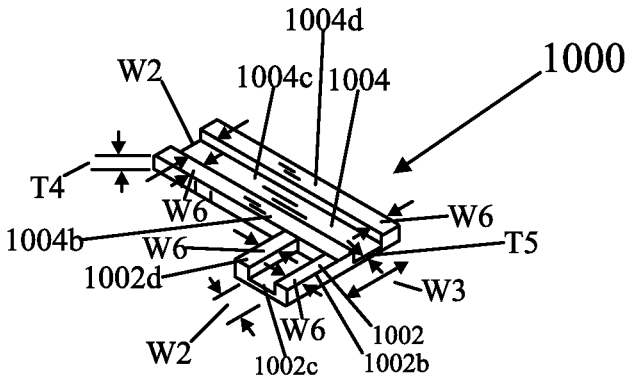
FIG. 8A shows a top, front, right view of a fifth connecting piece in accordance with another embodiment of the present invention.
Figure 8B:
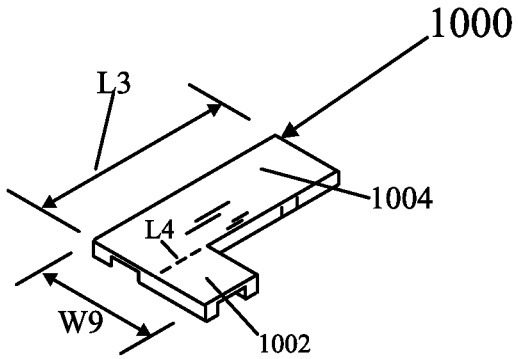
FIG. 8B shows a bottom, front left view of the fifth connecting piece of FIG. 8A.

FIG. 8A shows a top, front, right view of a fifth connecting piece 1000 in accordance with another embodiment of the present invention. FIG. 8B shows a bottom, front left view of the fifth connecting piece 1000. The connecting piece 1000 includes a section 1004 and a section 1002. The sections 1002 and 1004 may be integrated together as one piece. The section 1002 and the section 1004 together perform the function of connecting pieces 700 and 400 as shown in FIG. 5D. The section 1002 may be identical or substantially similar to the piece 700 and the section 1004 may be identical or substantially similar to the piece 400.

The section 1002 has rails or protrusions 1002*d* and 1002*b* separated by channel 1002*c*. The section 1004 has rails or protrusions 1004*b* and 1004*d* separated by channel 1004*c*. The piece has thicknesses T4 and T5, widths W2, W3, and W6 as described previously with reference to piece 400 of FIG. 4A. In accordance with an embodiment of the present invention the piece 1000 is L-shaped and may have a length L3, and a width W9, referring to FIG. 8B. A line L4, is merely used for descriptive purposes in FIG. 8B to show where the sections 1002 and 1004 are located.

The L-shaped connecting piece of FIGS. 8A and 8B may be large to connect floor planks or tiles more easily. For example, the length L3 may be about thirty-six inches long, and the width W9 may be six inches wide, typically for a floor plank. The length L3 may be eighteen and one eighth (⅛) inches long and the width W9 may be twelve and one eighth of an inch wide for a tile. The L-shaped connecting piece of FIGS. 8A and 8B may be applied to the floor planks 1, 201, 301, 501, and/or 601 with an adhesive or tacky substance similarly or identically to as previously described with reference to FIGS. 5B-5D.

Figure 9A:
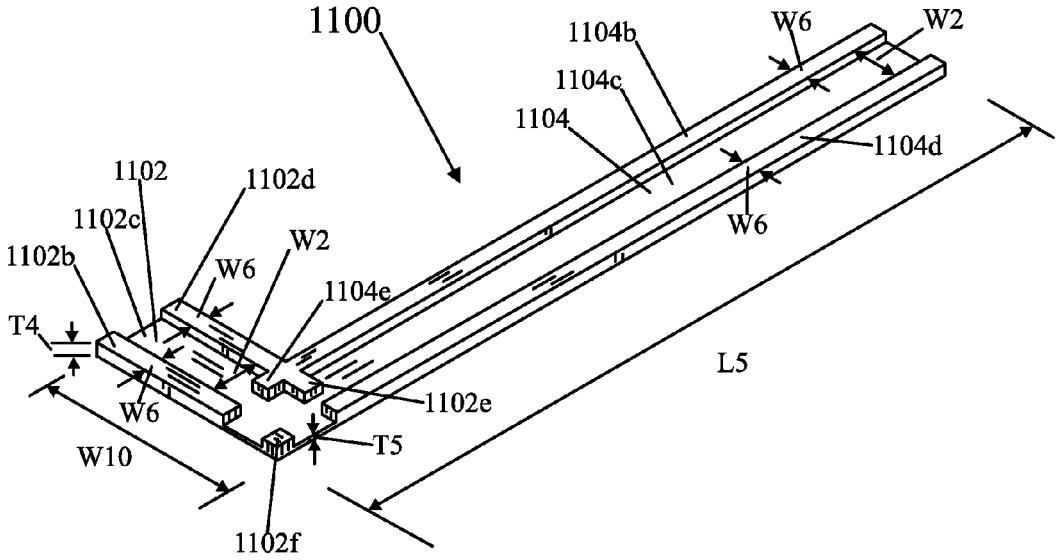
FIG. 9A shows a top, front, right view of a sixth connecting piece in accordance with another embodiment of the present invention.

FIG. 9A shows a top, front, right view of a connecting piece 1100 in accordance with another embodiment of the present invention. The connecting piece 1100 may include a section 1102 and a section 1104 which are integrated together into a single L-shaped piece. The connecting piece 1100 may be made of hard plastic.

The section 1104 includes rails or protrusions 1104*b* and 1104*d*, and channel 1104*c*. The section 1102 includes rails or protrusions 1102*b* and 1102*d*, and channel 1102*c*. The section 1104 also includes protrusion or rail 1102*f*. The rail 1104*b* has a section 1104*e* which extends beyond the rail 1102*d* by a distance of about W6. The rail 1102*d* has a section 1102*e* which extends beyond the rail 1104 by a distance of about W6. The rails 1104*b*, 1104*d*, 1102*b*, 1102*d*, and 1102*f* each have a width of W6, which may be as previously described for other connecting pieces, such as connecting piece 1000.

The channels 1102*c* and 1104*c* may have a width of W2, a thickness T5, a thickness T4, which may be as previously described, such as for connecting piece 1000. The connecting piece 1100 in Fig. A may have a length L5, which may be about the length L1 shown in FIG. 1A for the plank 1. The connecting piece 1100 may have a width W10 which may be about the same as the width W1 of the plank 1 shown in FIG. 1A. The section 1104 is at a right angle with respect to the section 1102. A bottom view of the connecting piece 1100 is not shown, however, typically the connecting piece 1100 would have a smooth, flat, uniform bottom surface, similar or identical to that shown for connecting piece 1000 in FIG. 8B.

Figure 9B:
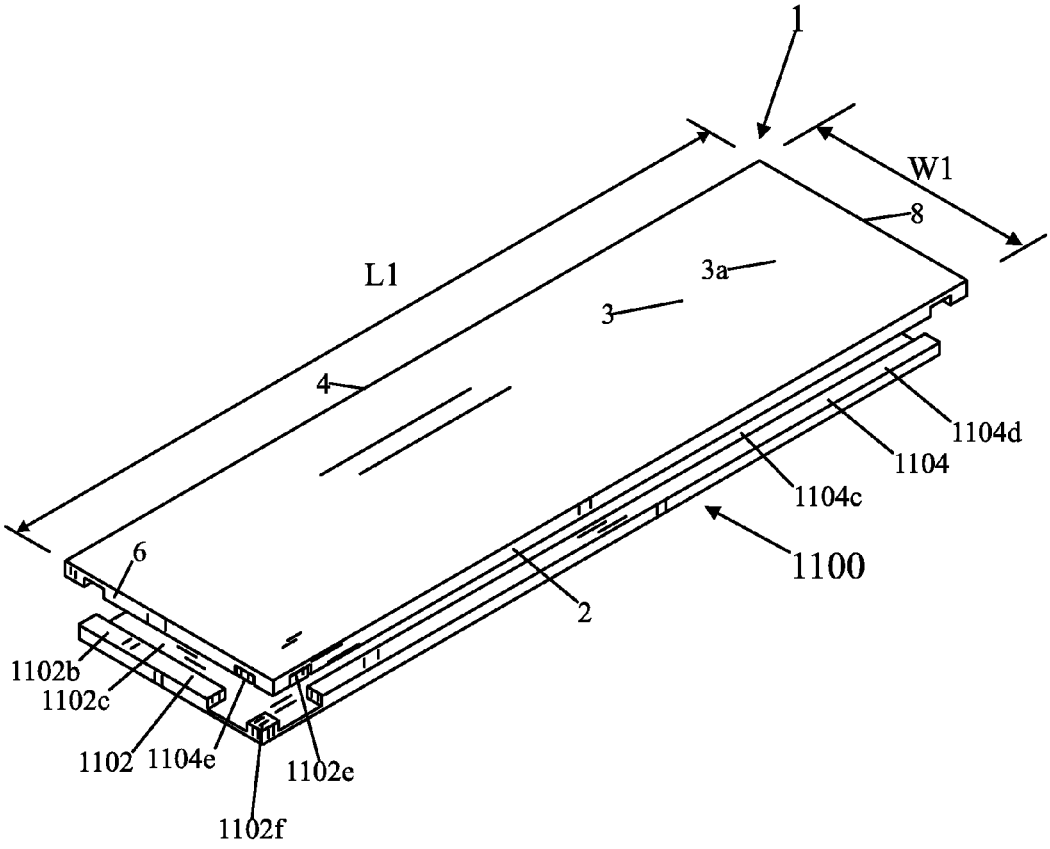
FIG. 9B shows a top, front, right view of the sixth connecting piece of FIG. 9A permanently connected to the plank of FIG. 1A.

FIG. 9B shows a top, front, right view of the connecting piece 1100 of FIG. 9A permanently connected to the plank 1 of FIG. 1A. In FIG. 9B, rails 6 and 2 of the plank 1 have been inserted into and lie in channels 1102*c* and 1104*c*, respectively. In at least one embodiment, the rails 6 and 2 are permanently connected to the connecting device 1100 in the channels 1102*c* and 1104*c*, respectively, such as by placing permanent glue in channels 1102*c* and 1104*c* prior to inserting the rails 6 and 2 of plank into channels 1102*c* and 1104, or by simply nailing the connecting piece 1100 to the plank 1, while the rails 6 and 2 are in the channels 1102*c* and 1104. The rails 6 and 2, typically make contact with the bottom of the channels 1102*c* and 1104 or are closely adhered to by a permanent adhesive. In accordance with an embodiment of the present invention, each of a plurality of planks, typically all planks which are to be used for forming a floor, each of which may be identical to plank 1 of FIG. 1A, have a connecting piece, which may be identical to connecting piece 1100, permanently connected thereto, in a similar or identical manner to as shown in FIG. 9B.

Figure 9C:
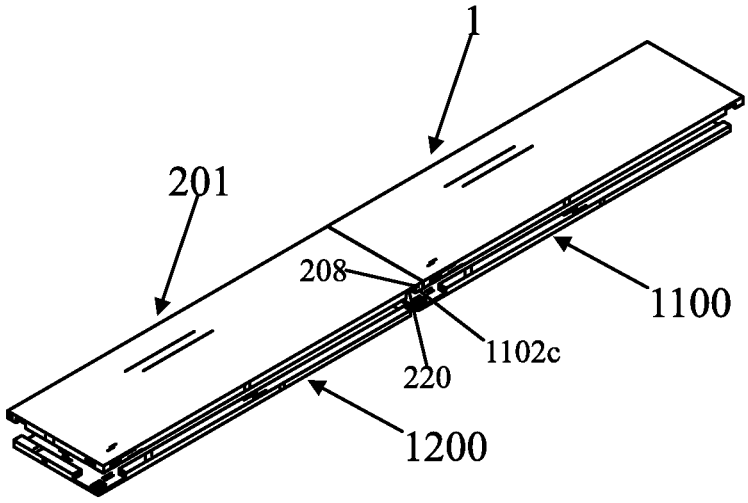
FIG. 9C shows a top, front, right view of the sixth connecting piece of FIG. 9A permanently connected to the plank of FIG. 1A, and a second identical plank permanently connected to a seventh connecting piece identical to the sixth connecting piece, with the second identical plank temporarily connected to the sixth connecting piece.

FIG. 9C shows a top, front, right view of the connecting piece 1100 of FIG. 9A permanently connected to the plank 1 of FIG. 1A, and a second plank 201 (which may be identical to plank 1) permanently connected to a connecting piece 1200 identical to the connecting piece 1100, with the second plank 201 temporarily connected to the connecting piece 1100. The rail 208 of the plank 201 is inserted or lies within the channel 1102*c* of the connecting piece 1100; and the rail or protrusion 1102*b* of the connecting piece 1100, shown in FIG. 9B, is inserted or lies in the channel 220 of the plank 201. The channels 1102*c*, 220, and/or rails 208, and 1102*b* may have a sticky or tacky substance, which is a non permanent adhesive, such as disclosed previously, placed thereon to temporarily adhere the rail 208 in the channel 1102*c* and the rail 1102*b* in the channel 220. For example, a special coating (which is tacky and/or sticky but not permanent) such as the anti-slip coating of a composition A, disclosed in patent application Ser. No. 13/851,635, filed on Mar. 27, 2013, incorporated by reference herein, or a hot-melt pressure sensitive glue such as disclosed in U.S. Pat. No. 8,268,110, incorporated by reference herein may be used to temporarily adhere the rail 208 in the channel 1102*c* and the rail 1102*b* in the channel 220. The planks 1 and 201 in the temporarily connected state are shown aligned in FIG. 9C.

The combination of plank 201 and connecting piece 1200 (which may have been permanently connected previously, similar to plank 1 and piece 1100) can be easily connected to plank 1 by placing the plank 201 so that rail 208 goes into channel 1102*c* and rail 1102*b* goes into channel 220, without requiring any movement or adjustment of plank 1.

Figure 9D:
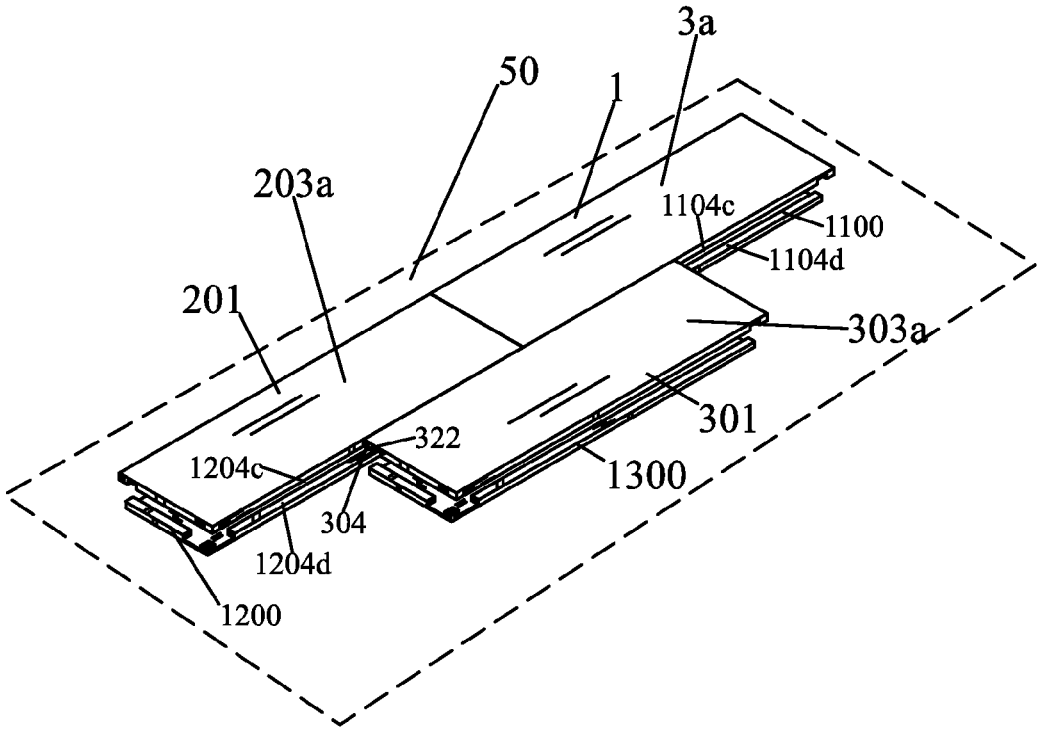
FIG. 9D shows a top, front, right view of the sixth connecting piece of FIG. 9A permanently connected to the plank of FIG. 1A, the second identical plank of FIG. 9C permanently connected to the seventh connecting piece identical to the sixth connecting piece, the second identical plank temporarily connected to the sixth connecting piece, a third identical plank temporarily connected to an eighth connecting piece, and the third identical plank temporarily connected to the sixth and seventh connecting pieces.

FIG. 9D shows a top, front, right view of the connecting piece 1100 permanently connected to the plank of FIG. 1, the plank 201 permanently connected to the connecting piece 1200 (identical to connecting piece 1100), the second plank 201 temporarily connected to the connecting piece 1100, the third plank 301 temporarily connected to a connecting piece 1300 (identical to connecting piece 1100) and third plank 301 temporarily connected to the connecting pieces 1100 and 1200.

The plank 301 is permanently connected to the connecting piece 1300 prior to temporarily connecting the combination of plank 301 and piece 1300 to the planks 1 and 201. The plank 301 and connecting piece 1300 combination is placed so that the rail 304 is partially inserted into channel 1204*c* of the connecting piece 1200, the rail 1204*d* of the connecting piece 1200 is partially inserted into the channel 322 of the plank 301, the rail 304 is partially inserted into the channel 1104*c* of the connecting piece 1100, and the rail 1104*d* of the connecting piece 1100 is partially inserted into the channel 322 of the plank 301.

The channels 1204*c*, 322, 1104*c*, and/or rails 304, 1204*d*, and 1104*d* may have a sticky or tacky substance, which is a non permanent adhesive, such as disclosed previously, placed thereon to temporarily adhere the rail 304 in the channels 1204*c* and 1104*c* and the rails 1204*d* and 1104*d* in the channel 322. For example, a special coating (which is tacky and/or sticky but not permanent) such as the anti-slip coating of a composition A, disclosed in patent application Ser. No. 13/851,635, filed on Mar. 27, 2013, incorporated by reference herein, or a hot-melt pressure sensitive glue such as disclosed in U.S. Pat. No. 8,268,110, incorporated by reference herein may be used to temporarily adhere the rail 304 in the channels 1204*c* and 1104*c* and the rails 1204*d* and 1104*d* in the channel 322. The plank 301 temporarily connected to planks 1 and 201 is shown in FIG. 9D. The planks 1, 201, and 301 are connected temporarily on a floor surface In FIG. 9D, the planks 1, 201, and 301 have been laid on a floor surface 50 shown by dashed lines. Top surfaces 3*a*, 203*a*, and 303*a* of the floor planks 1, 201, and 301 are substantially or completely aligned, so that a smooth, level floor is formed comprised of planks 1, 201, 301, and any further number of planks or floor tiles.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus for flooring comprising:

a first connecting piece;

a first floor plank;

a second floor plank;

wherein the first connecting piece connects the first floor plank to the second floor plank;

wherein the first connecting piece is L-shaped, having a first section and a second section, with the first section of the first connecting piece substantially perpendicular to the second section of the first connecting piece;

wherein the first section of the first connecting piece has a first rail, a second rail, and a first channel in between the first rail and the second rail of the first connecting piece;

wherein the second section of the first connecting piece has a third rail, a fourth rail, and a second channel in between the third rail and the fourth rail of the first connecting piece;

wherein the first and second rails and the first channel of the first section of the first connecting piece are parallel to each other and substantially perpendicular to the third and fourth rails, and the second channel of the second section of the first connecting piece;

wherein the first rail of the first section of the first connecting piece protrudes into the second channel of the second section; and wherein the second rail of the first section of the first connecting piece does not protrude into the second channel of the second section.

2. The apparatus of claim 1 wherein the third rail of the second section of the first connecting piece protrudes into the first channel of the first section; and wherein the fourth rail of the second section of the first connecting piece does not protrude into the first channel of the first section.

3. The apparatus of claim 1 wherein the first connecting piece is made substantially of plastic.

4. The apparatus of claim 1 wherein the first connecting piece is glued by a permanent glue to the first floor plank; and the first connecting piece is adhered by a temporary adhesive to the second floor plank.

5. The apparatus of claim 1 wherein the first connecting piece is made substantially of polypropylene.

6. The apparatus of claim 1 wherein wherein the first connecting piece is permanently connected to the first floor plank by the first rail of the first section of the first connecting piece being permanently connected to the first floor plank within a first channel of the first floor plank, and by the third rail of the second section of the first connecting piece being permanently connected to the first floor plank within a second channel of the first floor plank.

7. The apparatus of claim 4 wherein the first floor plank is temporarily connected to the second floor plank by a temporary adhesive by the second rail of the first section of the first connecting piece being temporarily connected by a temporary adhesive to the second floor plank within a first channel of the second floor plank.

8. The apparatus of claim 7 wherein the first connecting piece is permanently connected to the first floor plank by adhesive cement; and wherein the first floor plank is temporarily connected to the second floor plank by a pressure sensitive adhesive.

9. A method of forming a floor including a plurality of floor planks including a first floor plank and a second floor plank comprising:

connecting a first connecting piece to the first floor plank; and connecting the second floor plank to the first connecting piece to thereby connect the first floor plank to the second floor plank;

wherein the first connecting piece is L-shaped, having a first section and a second section, with the first section of the first connecting piece substantially perpendicular to the second section of the first connecting piece;

wherein the first section of the first connecting piece has a first rail, a second rail, and a first channel in between the first rail and the second rail of the first connecting piece;

wherein the second section of the first connecting piece has a third rail, a fourth rail, and a second channel in between the third rail and the fourth rail of the first connecting piece;

wherein the first and second rails and the first channel of the first section of the first connecting piece are parallel to each other and substantially perpendicular to the third and fourth rails, and the second channel of the second section of the first connecting piece;

wherein the first rail of the first section of the first connecting piece protrudes into the second channel of the second section; and wherein the second rail of the first section of the first connecting piece does not protrude into the second channel of the second section.

10. The method of claim 9 wherein the third rail of the second section of the first connecting piece protrudes into the first channel of the first section; and wherein the fourth rail of the second section of the first connecting piece does not protrude into the first channel of the first section.

11. The method of claim 9 wherein the first connecting piece is made substantially of plastic.

12. The method of claim 9 wherein the first connecting piece is glued by a permanent glue to the first floor plank; and the first connecting piece is adhered by a temporary adhesive to the second floor plank.

13. The method of claim 9 wherein the first connecting piece is made substantially of polypropylene.

14. The method of claim 9 wherein wherein the first connecting piece is permanently connected to the first floor plank by the first rail of the first section of the first connecting piece being permanently connected to the first floor plank within a first channel of the first floor plank, and by the third rail of the second section of the first connecting piece being permanently connected to the first floor plank within a second channel of the first floor plank.

15. The method of claim 12 wherein the first floor plank is temporarily connected to the second floor plank by a temporary adhesive by the second rail of the first section of the first connecting piece being temporarily connected by a temporary adhesive to the second floor plank within a first channel of the second floor plank.

16. The method of claim 15 wherein the first connecting piece is permanently connected to the first floor plank by adhesive cement; and wherein the first floor plank is temporarily connected to the second floor plank by a pressure sensitive adhesive.

* * * * *